United States Patent [19]

Sperduti

[11] 4,067,461

[45] Jan. 10, 1978

[54] SAFETY CONTROL APPARATUS FOR COKE OVEN BATTERIES

[75] Inventor: Anthony Sperduti, Hamburg, N.Y.

[73] Assignee: Bethlehem Steel Corporation, Bethlehem, Pa.

[21] Appl. No.: 742,390

[22] Filed: Nov. 15, 1976

[51] Int. Cl.[2] ..... C10B 33/08

[52] U.S. Cl. ..... 214/23; 202/262; 318/467; 318/600

[58] Field of Search ..... 214/18 R, 23, 16.4 A; 202/262; 318/467, 600

[56] References Cited

U.S. PATENT DOCUMENTS

| | | | |
|---|---|---|---|
| 3,124,736 | 3/1964 | Randell et al. | 214/23 X |
| 3,304,241 | 2/1967 | Radcliffe et al. | 214/23 X |
| 3,737,056 | 6/1973 | Hathcock | 214/16.4 A |

*Primary Examiner*—Robert G. Sheridan
*Attorney, Agent, or Firm*—Joseph J. O'Keefe; John I. Iverson; Robert M. Jones

[57] ABSTRACT

A programmed pusher machine and coke guide machine are provided with interlocks, and ovens are each provided with identifying means that can be sensed by means on each of the machines, to insure that the scheduled oven in a coke oven battery is safely pushed.

8 Claims, 5 Drawing Figures

SAFETY CONTROL APPARATUS FOR COKE OVEN BATTERIES

BACKGROUND OF THE INVENTION

This invention relates to safety control apparatus for coke oven batteries. More particularly, it relates to an automatic interlocking control system to insure the safe operation of a coke oven pushing sequence.

A coke oven battery comprises a plurality, e.g., 50 or more, of ovens contiguously aligned. A pusher machine is supported on rails disposed parallel to the battery on one side of the ovens and is provided with door-removing means and a ram for pushing coke out of any oven. A coke guide machine is supported on rails disposed parallel to the battery on the side of the battery opposite to the pusher machine. The guide machine is provided with door-removing means and a coke guide. The coke guide guides coke as it is pushed out of an oven and into a railroad car. This car is referred to as a "hot car" and is supported on rails disposed parallel to and adjacent to the coke guide machine rails.

Coke ovens are pushed periodically, e.g., every 16 hours after loading with coal. In order to prevent any section of the battery from cooling, the oven pushing sequence is arranged so that only ovens that are relatively distant from each other are consecutively pushed. For example, the pushing sequence may specify that oven Nos. 3, 13, 23, etc., be consecutively pushed.

Before an oven is pushed, each of the machine operators must be certain that his machine is positioned with its door-removing apparatus aligned with the oven scheduled to be pushed. Next, each operator removes the door on his side of the oven and stores this door on his respective machine. The guide machine operator must next move his machine along the tracks until the coke guide is aligned with the open oven. If the hot car is in position to receive coke, the pusher can then begin to push coke with his ram.

Because of the physical configuration of both a coke pusher and a guide machine, the operator of either machine may be uncertain whether his machine is aligned with the oven he believes is scheduled to be pushed. Thus, prior coke pushing control systems provided each of these machines with a sensing device to enable the operator to determine which oven his machine was opposite.

One of the devices comprised means positioned on both sides of each oven for mechanically actuating counters on the pusher and guide machines as these machines were driven past the ovens.

Another device comprised electromagnetic sensing means on each machine that counted the ovens as the machine traveled by them. If either of these counters were to skip, or receive a spurious signal from another source, the entire system would malfunction.

Still another prior art pushing control system comprised a central control station that received pulses from the moving pusher and guide machine. Agreement between the number of pulses received and the number dialed at the central control station resulted in the release of interlocking safety devices.

The success of the last-named prior art control system was predicated upon the dial operator knowing where the pusher and guide machines were initially. The dial operator then had to send out either one or two pulses to control the direction of machine travel. Next, a number was dialed to control the number of pulses to be received to indicate proper oven alignment. The high probability of error in such a system is obvious.

It is an object of this invention to provide a control system for a coke oven battery that is independent of mechanical and/or electromagnetic means that counts the ovens that each machine passes in order to know which oven that machine is opposite.

It is a further object of this invention to provide an improved interlocking control system for a coke oven battery.

SUMMARY OF THE INVENTION

I have discovered that the foregoing objects can be obtained by programming the guide machine with a sequence of ovens to be pushed. Means is provided on the guide machine for sensing the number of the oven with which the door-removing means of the guide machine is aligned, and means is provided for preventing the guide machine door-removing apparatus from operating if the number of the oven programmed to be pushed does not agree with the number of the oven sensed.

In its more limited aspects, the invention comprises means on the coke guide machine for storing a door removed from any of the ovens and producing a signal indicating such storage. Means is responsive to this signal for adding to the number sensed by the sensing means a number equal to the number of ovens separating the door-removing means and the coke guide on the coke guide machine. This insures the proper alignment of the coke guide after the coke guide machine has removed the door from the oven to be pushed.

In its even more limited aspects, the invention comprises further interlocking means that insure that the pushing sequence is progressing in the desired fashion.

DESCRIPTION OF THE PREFERRED EMBODIMENT

Figure 3:
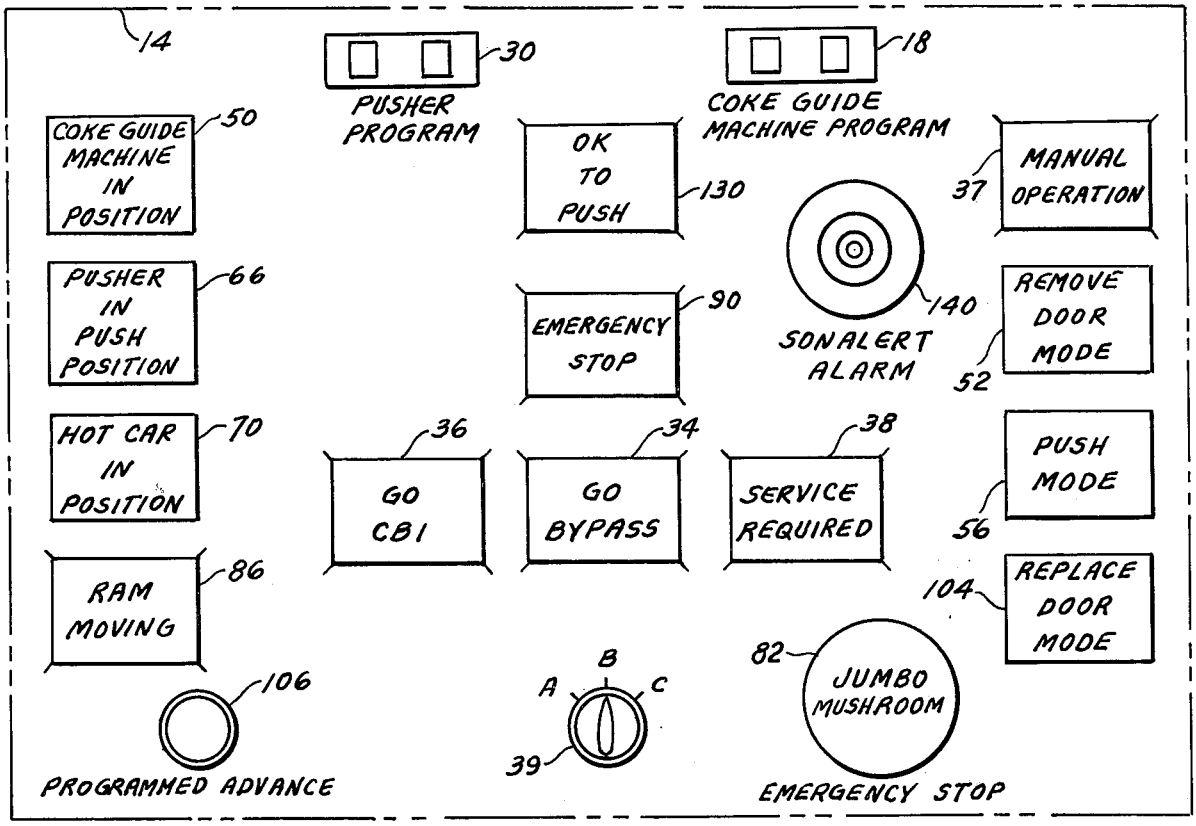
FIG. 3 is a diagram of the coke guide machine operator's control panel.

Both the coke guide machine and the pusher machine are provided with a control circuit comprising a programmer 10 and 12, respectively, that contains the sequence of ovens desired to be pushed. Each programmer supplies a signal to its respective operator's panel 14 and 16, shown in FIGS. 3 and 4, respectively. These signals provide a visual display 18 and 20, respectively, indicative of the next oven in the sequence to be pushed. In addition, the guide machine is provided with a transmitter 22 that transmits this information to a receiver 24 on the pusher machine. Similarly, the pusher machine is provided with a transmitter 26 that transmits this information to a receiver 28 on the guide machine. Thus, a visual display 30 is provided on the guide machine's panel of the pusher machine's program, and a visual display 32 is provided on the pusher machine's panel of the guide machine's program.

The signal from the programmer 10 passes through a 2-digit door display 48 that produces the visual display 18. In addition, the signal from the display 48 is encoded in an encoder 49 before passing to the transmitter 22.

Check signals are transmitted between these transmitters 22 and 26. If any difficulty in transmission develops, the "Go Bypass" lamp 34 on each control panel lights and the subject interlocking system cannot be used to control the pushing operation. If there is no difficulty, the "Go CBI" lamp 36 lights.

Figure 1A:
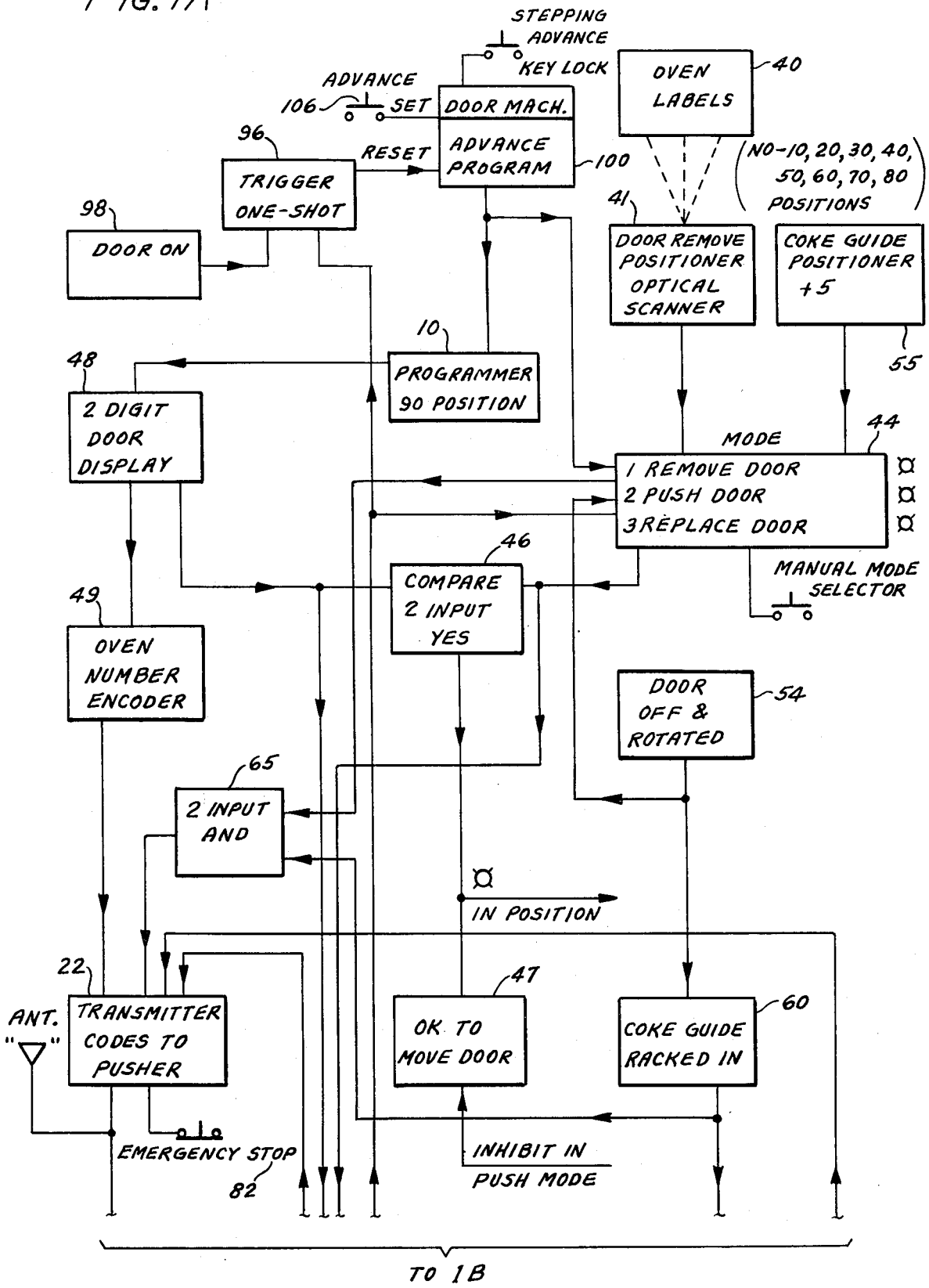
FIGS. 1A and 1B combine to form a block diagram of the control circuit for the coke guide machine.
Figure 1B:
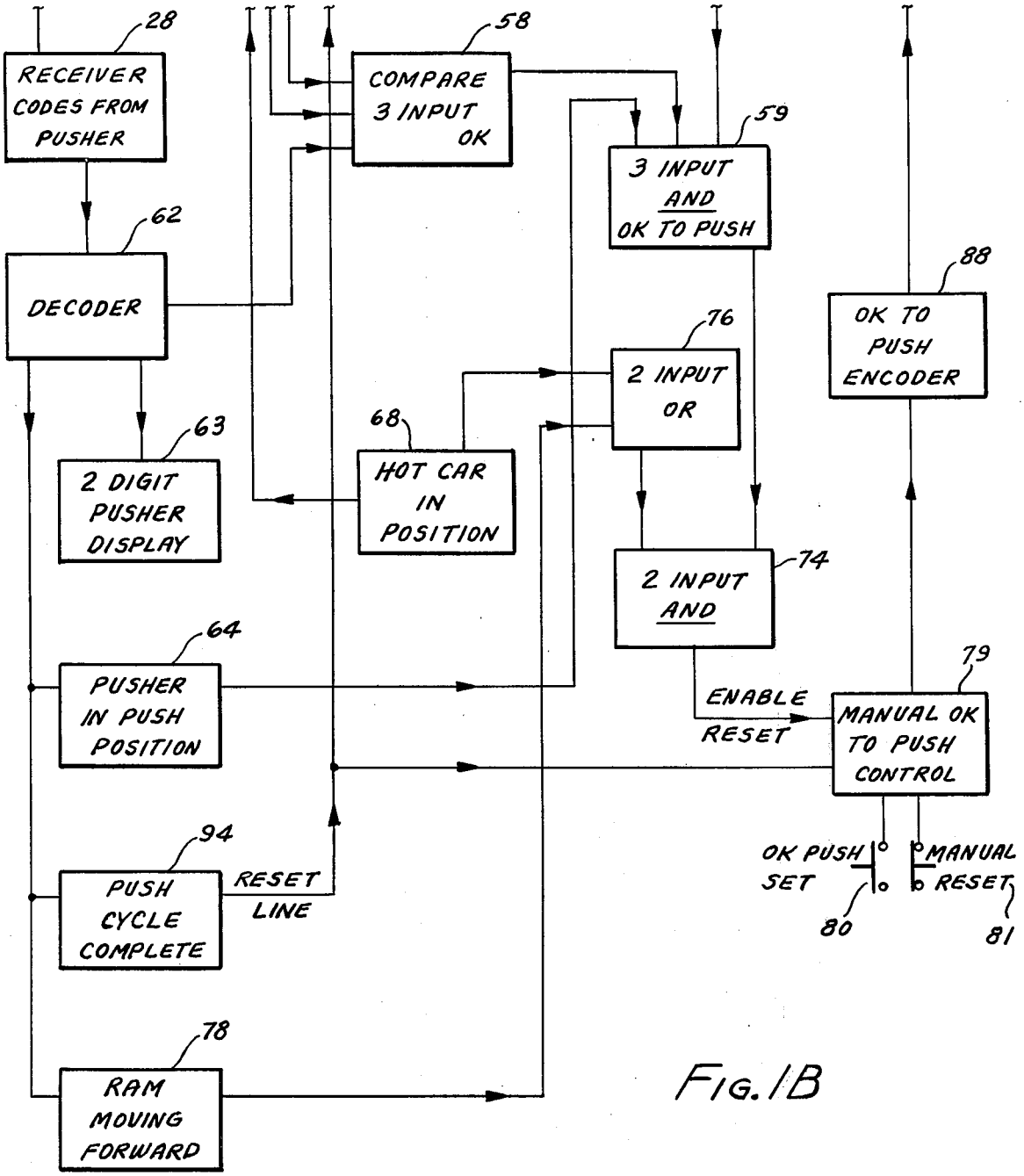
Figure 2:
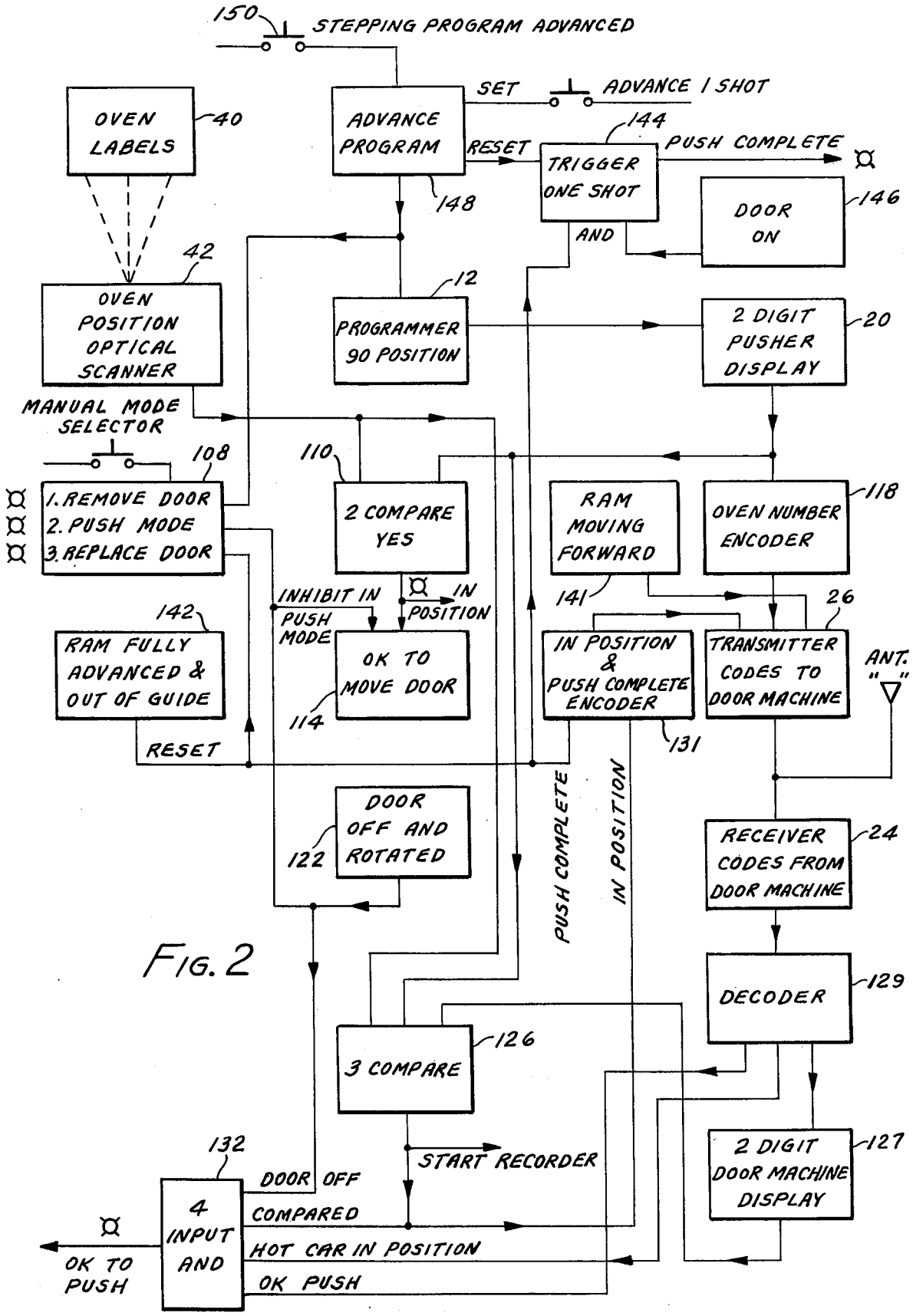
FIG. 2 is a block diagram of the control circuit for the pusher machine.

The control systems shown in FIGS. 1A, 1B, and 2 are also continuously checked for operability by well-known means, not shown. Here, also, if there is any difficulty, the "Go Bypass" lamps 34 light, as do the "Service Required" lamps 38. The operators may then operate manually, i.e., without benefit of the subject invention, in which case lamps 37 light on the control panels.

The coke guide and pusher machine's control panels are each provided with a 3-position key lock 39 and 45, respectively. In the central position B, the subject invention may be practiced. Rotating either lock 39 and 45 counterclockwise into position A bypasses the subject invention. Rotating either lock 39 and 45 clockwise into position C causes the programmer to successively advance at one second intervals to the next number oven in the pushing sequence.

In order to eliminate errors arising from the determination of an oven number by mechanical or electromagnetic counting of ovens by the action of the moving coke guide machine, located on both sides of each oven are identifying means that can be sensed by means mounted on the coke guide machine and pusher machine. As shown in FIG. 1A, this identifying means is preferably labels 40. These labels may be coded horizontal reflective bar labels, such as those manufactured and sold by Identicon Corporation, Waltham, Mass.

Mounted on both the coke guide machine and the pusher machine are means for sensing the labels. These means are optical scanners 41 and 42, respectively, for the guide and pusher machines. A suitable scanner is a vidicon camera such as those manufactured and sold by Identicon Corporation, Waltham, Mass. The output from the scanner 41 on the guide machine is fed to a mode selector 44, which is an interlocking device that permits the coke guide machine to operate in only one of three possible modes, viz.: (1) remove door mode, (2) push mode, and (3) replace door mode. While the mode selector is in mode (1), the only permissible function of the coke guide machine is to remove the door from an oven. Similarly, while the mode selector is in mode (2), only a push can occur; in mode (3) only a door can be replaced.

Initially, the mode selector is in mode (1). The coke guide machine is moving along the tracks and optical scanner 41 is reading the labels and supplying signals indicative of the label numbers through the mode selector 44 to one input of a 2-input comparator 46. The other input of this comparator receives a signal from a 2-digit door display 48 connected to the guide machine programmer 10.

If both inputs to the comparator 46 are in agreement, the comparator 46 actuates a relay in module 47 permitting the door opposite the guide machine to be removed. In addition, comparator 46 supplies a signal to the coke guide machine operator's panel 14 that lights "Coke Guide Machine in Position" lamp 50. The relay in module 47 is inhibited from permitting a door to be removed while the mode selector 44 is in the push mode.

If the mode selector 44 is not in either the push mode or the replace door mode, and the lock 39 is not in position A, the "Remove Door Mode" lamp 52 lights on the panel 14. The operator then removes the oven door, rotates it, and places it in storage means disposed on the coke guide machine that actuates module 54.

Module 54 contains a switch that, in response to the placing of a door therein, actuates a module 55 connected to the mode selector 44. Module 55 adds to the number sensed by the optical scanner 41 a number equal to the number of ovens separating the door-removing means and the coke guide on the coke guide machine. In this particular case, this separation is five ovens.

The coke guide machine operator then moves his machine a distance of five ovens in a direction such that the coke guide is aligned with the open oven. If: (1) the number read by the optical scanner 41, adjusted by five, agrees with the number of the scheduled oven, (2) the door has been stored, (3) the mode selector is not in the replace door mode, and (4) the position selector is in position B, the mode selector switches into the push mode and a "Push Mode" lamp 56 lights on the control panel.

The guide machine's control circuit is provided with a 3-input comparator 58 that receives a first signal from the optical scanner 41 (adjusted for the five oven shift). A second input to the comparator 58 is supplied a signal from the 2-digit door display 48 indicative of the oven scheduled to be pushed. The third input is the signal transmitted by the pusher machine indicating the oven scheduled to be pushed on the pusher machine's programmer 12. This third input signal is decoded by a decoder 62 and passes through a 2-digit pusher display module 63 before feeding into the comparator 58.

The output from the 3-input comparator 58 is one input to a 3-input AND 59. A second input is a signal from a module 60, actuated by movement of the coke guide, indicating that the guide has been in position against the oven for at least 5 seconds. A third signal is transmitted from the pusher machine, received by the guide machine receiver 28, decoded by the decoder 62, and supplied from module 64 to indicate that the pusher machine is in the push position. This last signal causes a "Pusher in Push Position" lamp 66 to light in the guide machine's panel 14.

The signal from module 60 also provides one input of a 2-input AND module 65. The other input is a signal from the mode selector 44 indicating that it is in the push mode. The output from the module 65 causes a signal to be transmitted to the pusher machine that lights a lamp 67.

The hot car is driven along its tracks until it strikes a projection on the coke guide machine that closes a limit switch. This actuates a module 68 that causes a signal to light a lamp 70 on the guide machine operator's panel and also transmits a signal to the pusher machine operator's panel that lights a "Hot Car in Position" lamp 72. A signal indicating that the guide machine is in push position is thus transmitted to the pusher machine if the following conditions exist:

1. The mode selector 44 is in the push mode.
2. The coke guide has been in position for at least 5 seconds.
3. The hot car is in position. (As will be explained later, the signal indicating this condition persists after a button has been depressed indicating that it is all right to push coke.)

The output from the 3-input AND 59 supplies one input of a 2-input AND 74. The other input receives a signal from a 2-input OR 76 indicating either that the hot car is in position or that the ram on the pusher machine is moving forward. The "Hot Car in Position" signal is supplied by module 68, whereas the "Ram Moving Forward" signal is supplied by a module 78. A relay in a module 79 enabling the coke guide machine operator to depress the "OK to Push" button 80 is then closed if the following conditions exist:

1. The guide machine's and the pusher machine's programs are in agreement.
2. An "Emergency Stop" button 82 on the guide machine operator's panel has not been depressed.
3. The guide machine is in push position.
4. The pusher machine is in push position.

Depressing the "OK to Push" button 80 causes lamp 130 to light and closes a latch relay that keeps the enabling relay closed until a reset signal is received by depressing manual reset button 81. However, this relay will open if the hot car moves before the push is started. During the period these relays are closed, an "OK to Push" signal is continuously transmitted to the pusher machine.

If all is proper on the pusher machine, the ram may be driven forward to push coke out of the oven and into the hot car. A signal from the pusher machine continuously lights a lamp 86 on the guide machine operator's panel and pulses the sonalert alarm 140 while the ram is being driven forward.

If the "OK to Push" button 80 has been depressed and the ram is moving forward, an "OK to Push" module 88 is locked into a position that causes it to transmit an "OK to Push" signal continuously as long as the mode selector 44 is in the push mode.

During the push, an emergency stop relay will stop the ram from moving forward if transmission between the pusher and the guide machines is interrupted. The pusher operator must then retract the ram. This relay lights lamps 90 and 92 on the guide machine's and pusher machine's panels, respectively.

After the push has been completed, the guide machine module 94 receives a signal transmitted from the pusher. This module performs the following functions:

1. It disenables push button 80.
2. It switches the mode selector into the replace door mode.
3. It satisfies one input of a 2-input trigger one-shot 96, the second input being satisfied by a signal from a module 98 when the removed door is placed back on the oven.

An output signal from the trigger one-shot 96 resets a module 100 that advances the programmer 10 when a button 106 is depressed. In addition, the module 94 causes the "Replace Door Mode" lamp 104 on the guide machine operator's panel to light. This lamp continues to be lit while all of the following conditions exist:

1. The mode selector 44 is in the replace door mode.
2. The program has not been advanced as a result of manual depression of the "Advance Program" button 106 on the guide machine's panel.
3. The key lock 39 is in position B.

The program for the guide machine can be advanced by one of two methods. If the key lock 39 is in position B, the module 98 produces a time-delayed signal indicating that the door has been replaced. If the mode selector 44 is in the replace door mode, the program can then be advanced by depressing the "Advance Program" button 106. This automatically switches the mode selector 44 into the remove door mode.

If the key lock 39 is in position C, the program automatically advances one step in the sequence per second while the mode selector 44 is in the remove door mode.

Figure 4:
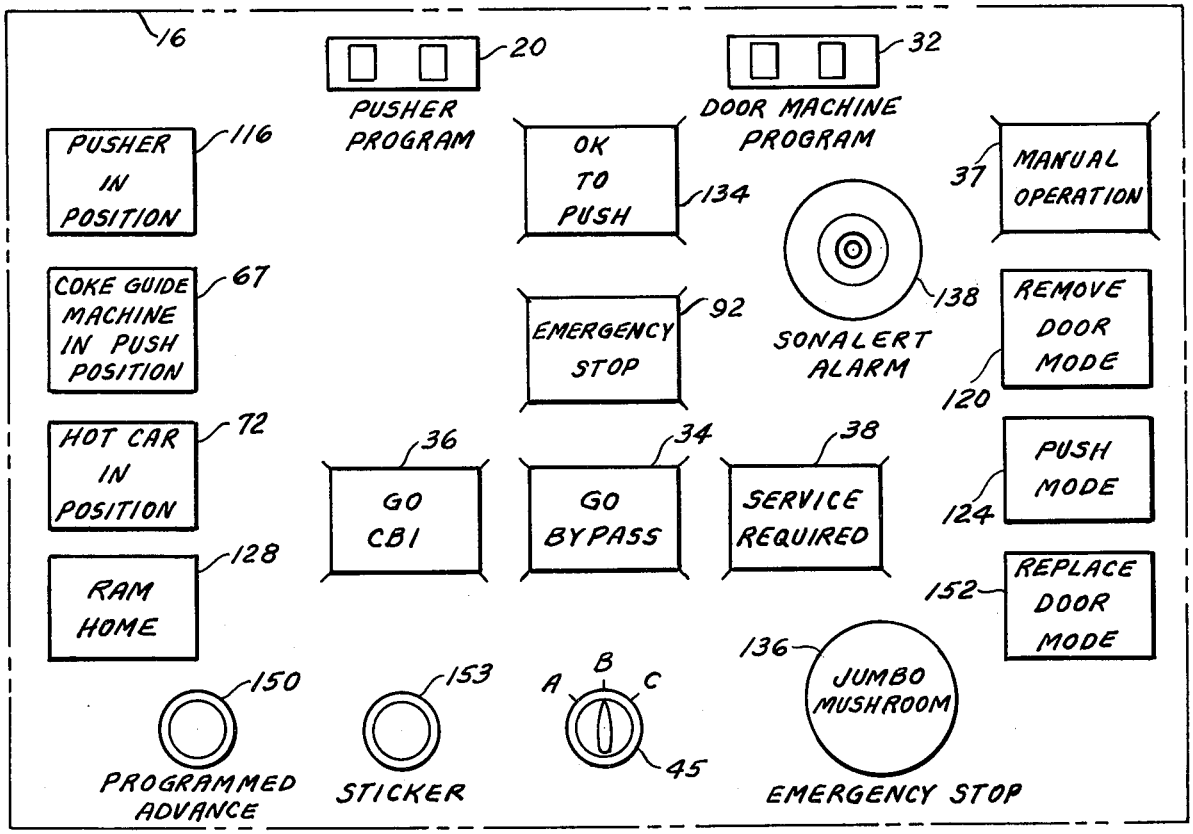
FIG. 4 is a diagram of the pusher machine operator's control panel.

The control system for the pusher machine will next be described with reference to FIGS. 2 and 4.

Mounted on the pusher machine is an optical scanner 42, e.g., a vidicon camera, for reading coded horizontal reflective bar labels 40 identifying each of the ovens in the battery. The output from the camera 42 is fed to a mode selector 108 substantially similar to that included in the coke guide machine's control circuit.

Initially, the mode selector 108 is in mode (1), i.e., the remove door mode. The pusher machine moves along the tracks, while the optical scanner 42 reads the labels 40 and transmits signals indicative of the label numbers to one input of a 2-input comparator 110. The other input of this comparator receives a signal from a 2-digit pusher display 112 connected to the pusher machine programmer 12. If both inputs to the comparator are in agreement, the comparator actuates a relay in module 114 permitting the door to be removed and causes a "Pusher in Position" lamp 116 to light on the pusher machine operator's panel 16.

The signal from the 2-digit pusher display 112 is also sent to an encoder 118 that encodes the signal and feeds it to the transmitter 26. This signal is received by the guide machine, which displays the oven number in visual display 30.

A "Remove Door Mode" lamp 120 lights if the following conditions exist:

1. The mode selector 108 is in neither the push mode nor the replace door mode.
2. The key lock 45 is not in position A.

If the key lock 45 is in position A, or if the pusher machine is in position and the mode selector 108 is not in the push mode, a relay is actuated that permits the door to be removed from the oven that the pusher machine is aligned with. The operator then removes the oven door, rotates it, and places it in storage means located on the pusher machine that actuates module 122.

The mode selector 108 will now switch into the push mode if the following conditions are met.

1. The pusher is in position.
2. The door has been stored in the storage means for at least 5 seconds.
3. The mode selector 108 is not in the replace door mode.
4. The key lock 45 is in position B.

Lamp 124 then lights on the pusher machine operator's control panel and lamp 120 goes out.

The outputs from the optical scanner 42 and the 2-digit pusher display 112 are supplied to first and second inputs, respectively, of a 3-input comparator 126. The third input is a 2-digit coke guide machine display 127 transmitted by the transmitter 22 and decoded by decoder 129 after being received by receiver 24. If these three inputs are satisfied, and the ram is retracted in its so-called "home" position, which is indicated by a lamp 128, module 131 causes transmitter 26 to transmit to the guide machine a signal that causes "Pusher in Push Position" lamp 66 on the guide machine operator's control panel to light. In addition, a recorder starts to record the current drawn by the ram motor. Variations in this current are useful in analyzing push times between charges as well as maintenance problems such a lining wear in an oven.

Lamp 124 will stay lit after the ram has left its "home" position if the "OK to Push" signal is being transmitted from the guide machine to the pusher.

The pusher control circuit contains a 4-input AND 132 that lights an "OK to push" lamp 134 on the pusher operator's control panel when the following conditions exist:

1. The door has been removed from the pusher side of the ovens and stored in the pusher machine.
2. The pusher is in push position, as indicated by the output from the 3-input comparator 126.
3. The hot car is in position.
4. The guide machine is in position, and conditions on the guide side of the ovens are ready for the push.
5. The carrier signal transmitted by the coke guide machine is continuously received by the receiver on the pusher machine.
6. Neither the emergency stop button 82 on the guide machine nor an emergency stop button 136 on the pusher machine has been depressed.

The pusher operator then starts the ram moving foward and an audible alarm 138 on the pusher and an identical alarm 140 on the guide machine are actuated. These alarms continue as long as there is an output signal from module 141, which transmits a signal to the guide machine indicating that the ram is moving forward. If the ram stops moving forward, the alarms stop.

If the push progresses normally, module 131 causes a "Push Complete" signal to be transmitted when the following conditions exist:

1. The "OK to Push" signal is on.
2. The ram has fully advanced through the oven and the coke guide.
3. The ram has retracted out of the coke guide and has been out of the guide for several seconds.

After the ram has retracted out of the guide, a module 142 produces a signal that results in module 131 causing transmitter 26 to transmit a "Push Complete" signal. In addition, this signal satisfies one input of a 2-input trigger one-shot 144, the other input being satisfied by a signal from a module 146 when the removed door is placed back on the oven.

An output signal from the trigger one-shot 144 resets a module 148 that advances the programmer 12 when a button 150 is depressed. This signal also switches the mode selector 108 into the replace door mode, thereby causing "Push Mode" lamp 124 to go out and lighting "Replace Door Mode" lamp 152. However, this switching of modes occurs only if the key lock 45 is in position "B".

Occasionally, a "sticker" occurs. A "sticker" is an oven that cannot be pushed because, for example, the coke in the oven has caked as a result of excessive "cook" times due to delays in pushing. In this event, the pusher operator depresses the "sticker" button 153. A signal indicating that the push is complete is then transmitted to the guide machine if, in addition, the guide machine is in the push position and the pusher machine is in the push mode.

As above noted, after the door has been replaced, the program can be advanced to the next oven in the sequence by depressing button 50 while the mode selector is in the replace door mode. This automatically causes the mode selector to switch into the remove door mode.

As in the case of the coke guide machine, the program on the pusher machine can also be advanced by moving the key lock 44 into position C, as this causes the program to automatically advance one step in the sequence per second while the mode selector is in the remove door mode.

I claim:

1. In a system for sequentially removing coke from a battery of sequentially numbered coke ovens, said system comprising a pusher machine having door-removing means and a ram mounted thereon, said pusher machine being adapted to traverse tracks disposed along one side of said ovens, a coke guide machine having door-removing means and a coke guide mounted thereon, the latter door-removing means and the coke guide being separated by an integral number of ovens, said coke guide machine being adapted to traverse tracks disposed on the other side of said ovens, and a hot car adapted to traverse tracks disposed parallel to said coke guide machine tracks and receive coke pushed out of said ovens by said ram, the improvement comprising:

a. means programming said coke guide machine with a sequence of ovens to be pushed and producing a signal indicative of the number of the next oven in said sequence,
b. means disposed on the coke guide side of each of said ovens indicative of the number of that particular oven,
c. means on said coke guide machine for sensing the number of the oven with which the door-removing means of said coke guide machine is aligned and producing a signal indicative of said number,
d. means for preventing the removing of an interlock that prevents the coke guide machine door-removing means from operating if the signal produced by means (a) does not agree with the signal produced by means (c),
e. means on said coke guide machine for storing a door removed from any one of said ovens and producing a signal indicating such storage,
f. means interposed between means (c) and means (d) that, in response to the signal from means (e), adds said integral number to the number sensed by means (c) to obtain a signal indicative of a modified number,
g. means programming said pusher machine with a sequence of ovens to be pushed and producing a signal indicative of the number of the next oven in said sequence,
h. means for transmitting a signal from the pusher machine to the coke guide machine,
i. means on said coke guide machine for receiving a signal from said pusher machine,
j. means connecting means (h) to means (g), and
k. means on said coke guide machine for producing a signal, that removes an interlock that prevents said ram from operating, in response to agreement between:
   1. the signal produced by means (a),
   2. the signal produced by means (f), and
   3. the signal produced by means (g) and transmitted from means (h) to means (i).

2. The improvement as recited in claim 1, further comprising:

l. means connected to means (h) for producing a signal indicative that the pusher is ready to push coke from the oven programmed to be pushed, m. means for producing a signal indicating that the coke guide is in position to guide coke into the hot car, and n. means for producing a signal, in response to a signal from means (k), means (l), and means (m), that removes an interlock that prevents said ram from operating.

3. The improvement as recited in claim 2, further comprising:

o. means for producing a signal indicating that the hot car is in position to receive coke, p. means for transmitting a signal from the coke guide machine to the pusher machine, and q. means for producing a signal, in response to a signal from means (n) and means (l), that enables the coke guide machine operator to cause means (p) to transmit a signal indicating that conditions on the guide machine side of the battery are suitable for pushing coke from the next oven in the sequence programmed to be pushed.

4. The improvement as recited in claim 3, further comprising:

r. means connected to means (h) for producing a signal indicating that said ram has completed pushing coke out of an oven and has fully retracted out of said coke guide, s. means responsive to the signal produced by means (r) for subtracting said integral number from the number sensed by means (c), t. means for producing a signal in response to the repositioning of said removed door on said oven, u. means for producing a triggering signal in response to a signal from means (r) and means (t), and v. means enabling means (a) to be advanced to the next oven number in said sequence in response to said triggering signal.

5. The improvement as recited in claim 1, further comprising:

l. means disposed on the pusher side of each of said ovens indicative of the number of that particular oven, m. means on said pusher machine for sensing the number of the oven with which the door-removing means of said pusher machine is aligned and producing a signal indicative of said number, and n. means for removing an interlock that prevents the pusher machine door-removing means from operating if the signal produced by means (g) does not agree with the signal produced by means (m).

6. The improvement as recited in claim 5, further comprising:

o. means for transmitting a signal from said coke guide machine to said pusher machine, p. means supplying means (o) with a signal to be transmitted indicative of the number of the oven the coke guide of the coke guide machine is aligned with when there is a door stored in means (e). and q. means for producing a signal, that removes an interlock that prevents said ram from operating, in response to agreement between:

1. the signal supplied to means (o) by means (p),
2. the signal produced by means (g), and
3. the signal produced by means (m).

7. The improvement as recited in claim 6, further comprising:

r. means on said pusher machine for storing a door removed from any of said ovens and producing a signal indicating that a door is being stored, s. means responsive to the storing of a door in means (r) for removing an interlock that prevents the ram on said pusher from operating, t. means supplying means (o) with a signal to be transmitted indicating that said hot car is in position to receive coke, u. means supplying means (o) with a signal to be transmitted indicating that conditions on the coke guide side of the battery are suitable for pushing coke from the oven programmed to be pushed, and v. means for producing a signal, in response to a signal from means (q), means (r), means (t), and means (u), indicating that conditions on both sides of the battery are suitable for the pushing operation to commence.

8. The improvement as recited in claim 7, further comprising:

w. means for producing a signal indicating that said ram has completed pushing coke out of an oven and has fully retracted out of said coke guide, x. means for producing a signal in response to the repositioning of said removed door on said oven by means on said pusher machine, y. means for producing a triggering signal in response to a signal from means (w) and means (x), and z. means enabling means (g) to be advanced to the next oven number in said sequence in response to said triggering signal.

* * * * *